US007647701B1

(12) United States Patent
Mollick et al.

(10) Patent No.: US 7,647,701 B1
(45) Date of Patent: Jan. 19, 2010

(54) FOLDING KNIFE WITH GUARD

(76) Inventors: Mark Mollick, 3545 W. Altadena Ave., Phoenix, AZ (US) 85029-3120; Paul Mollick, 3545 W. Altadena Ave., Phoenix, AZ (US) 85029-3120

( * ) Notice: Subject to any disclaimer, the term of this patent is extended or adjusted under 35 U.S.C. 154(b) by 20 days.

(21) Appl. No.: 11/339,905

(22) Filed: Jan. 25, 2006

Related U.S. Application Data

(60) Provisional application No. 60/648,371, filed on Jan. 28, 2005.

(51) Int. Cl.
*B26B 3/06* (2006.01)

(52) U.S. Cl. ..... 30/155; 30/158; 30/160; 30/161

(58) Field of Classification Search ..... 30/53, 30/155, 153, 158, 160, 161
See application file for complete search history.

(56) References Cited

U.S. PATENT DOCUMENTS

| | | | | | |
|---|---|---|---|---|---|
| 488,340 | A | * | 12/1892 | Skoglund | 30/160 |
| 749,230 | A | * | 1/1904 | Severence | 30/160 |
| 1,545,542 | A | * | 7/1925 | Albrecht et. al. | 30/53 |
| 2,199,430 | A | * | 5/1940 | Greve | 30/160 |
| 2,293,892 | A | | 8/1942 | Evinger | |
| 2,316,246 | A | * | 4/1943 | Hyatt | 30/153 |
| 2,901,824 | A | | 9/1959 | Zullo | |
| 3,108,375 | A | | 10/1963 | Pappa | |
| 4,073,057 | A | | 2/1978 | Gilbert | |
| 4,170,061 | A | | 10/1979 | Henry | |
| 4,802,279 | A | * | 2/1989 | Rowe | 30/155 |
| 5,440,814 | A | | 8/1995 | Hall et al. | |
| 5,581,893 | A | | 12/1996 | Ouellette | |
| 5,843,107 | A | * | 12/1998 | Landis et al. | 606/167 |
| 6,170,158 | B1 | * | 1/2001 | Daily | 30/161 |
| 6,233,832 | B1 | | 5/2001 | Berns | |
| 7,325,312 | B1 | * | 2/2008 | Janich | 30/161 |

OTHER PUBLICATIONS

A.G. Russell Catalog of Knives, Fall 2003, p. 2—A.G. Russell's Solingen Swing Guard.

* cited by examiner

*Primary Examiner*—Maurina Rachuba
(74) *Attorney, Agent, or Firm*—Gregory J. Nelson

(57) ABSTRACT

A guard for a folding knife which guard protects the fingers of the user when the blade is open. The guards may be lifted by the movement of the blade by a link, spring, lifting pin, gears, underside of the blade or hooked by thumb stud or back of blade or by a flipping motion due to the contour of the handles. The guards may be of various shapes and may be recessed in an out-of-the-way position when the blade is closed. The guards may extend at opposite sides of the blade and opposite sides of the handle. The guards are adaptable to a wide variety of folding knife styles.

30 Claims, 16 Drawing Sheets

FOLDING KNIFE WITH GUARD

CROSS-REFERENCE TO RELATED APPLICATION

This application is based on U.S. provisional patent application Ser. No. 60/648,371 filed Jan. 28, 2005, of the same title.

The present invention relates to knives and more particularly relates to folding knives with guards which, when the knife blade is opened, are extendable to protect the hand and fingers of the user from sliding forward off the handle onto the blade thus preventing possible injury.

BACKGROUND OF THE INVENTION

Folding knives of the type in which the blade is moveable between a position in the handle to an extended use position are well known and are very popular. Folding knives vary in style from the simple pocket knife to the more specialized knives such as hunting knives, bowie knives and camp knives. One popular folding knife is the well known scout knife which has a main blade and additional blades which may include leather punches, bottle openers, screw drivers, can opener and similar blades for specialized use. While these various types of folding knives may be provided in different sizes and different shapes, depending upon the particular style and intended use, they all include a main blade which is pivotally secured in a handle. In the unfolded or use position, the blade extends forwardly from the handle and the blade may be folded into the handle when not in use for safety and for compactness.

One particular safety concern when using knives, particularly folding knives, is that the user's hand can slip forwardly along the handle bringing the hand or fingers of the user into contact with the edge of the blade causing injury. As a result, there are suggestions in the prior art to provide various types of protection to the user's hand. Fixed blade knives often have a hilt which projects between the handle and blade as a safety feature.

U.S. Pat. Nos. 2,901,824 and 3,108,375 both show detachable finger guards for knives.

U.S. Pat. No. 6,233,832 shows a razor knife with a blade guard longitudinally displaceable on the handle between an outer, extended position and a retracted position exposing the point of the blade.

U.S. Pat. No. 2,293,892 shows a knife with a slidable blade guard which extends parallel with the space from the cutting edge to protect the user's thumb from the cutting edge when paring vegetables.

U.S. Pat. No. 4,170,061 shows a folding knife which has a cutting edge and projecting safety guard which is part of the blade.

U.S. Pat. No. 4,073,057 shows folding guards on a knife with a folding blade but the guards are for storage only when the blade is not in use and are in the nature of handle sections rather than guards.

U.S. Pat. No. 5,440,814 shows a knife with a fixed blade having pair of side guards mounted on the handle and moveable between an open and closed position. The guards enclose at least a portion of the blade when in the closed position. An actuating mechanism which includes a button moveable between a forward and rear position, is operable with a pair of side guards so that when the button is moved forward, the side guards move to the open position. When the button is moved rearwardly, the side guards move to the closed position.

Various types of guards or shields are commonly found with specialized knives such as utility knives. Reference is made to U.S. Pat. No. 5,581,893 which shows such a feature.

Pivotal swing guards mounted on the blade are available from manufacturers such as Solingen. These swing guards are hilt-like and close against the handle when the knife is closed, and open into the guard position when the blade is open.

While, as indicated above, there are various types of guards available with knives, there nevertheless exists the need for a guard for folding knives which is convenient, easy to use, which provides protection for the user's hands and fingers and which is both functional and aesthetically pleasing in design and detracting from the appearance of the knife.

BRIEF SUMMARY OF THE PRESENT INVENTION

Briefly, the present invention provides a folding knife having one or more guards which are pivotally mounted to the blade or to the handle or liner. When the blade is in the closed position, the guard is positioned in an out-of-the-way location in a recess within the handle or on top of the handle. When the blade is opened, a pivot mechanism raises the guards to an open, locked position generally perpendicular to the knife handle to prevent the user's hand from slipping forward. The guards have a pivotal mounting section and a finger stop section.

In one embodiment of the present invention, a lifting pin on one side or both sides of the blade rotates in a slot on the guard to raise or lower the guard by making contact with the slot ends. In another embodiment, the guard may be spring-actuated to the open position when the blade is opened. The folding guards can be any convenient shapes such as circular, rectangular, curved or other configurations, such as in the shape of an auxiliary tool. In the various embodiments, the lifting pins can be on the blade or guard and the folding guards can pivot about the same axis as the blade. In other embodiments, the guard may be a single or double guard which is raised by a link extending between the blade and guard. The various embodiments of the guard can be adapted to a wide variety of knife types and the folding guards can be used on knives with different locking mechanisms such as lock backs, liner locks, axis locks, button locks and the like.

BRIEF DESCRIPTION OF THE DRAWINGS

The above and other objects and advantages of the present invention will become more fully apparent from the following description, claims and drawings in which:

DETAILED DESCRIPTION OF THE DRAWINGS

Background

Figure 1A:
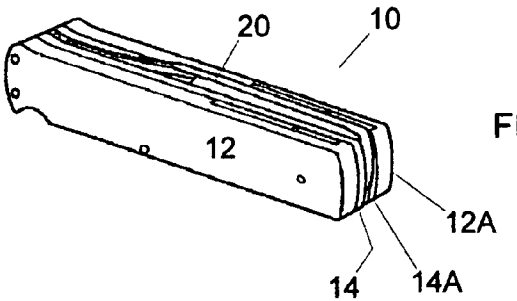
FIG. 1A shows the knife of FIG. 1 in a closed position.
Figure 1B:
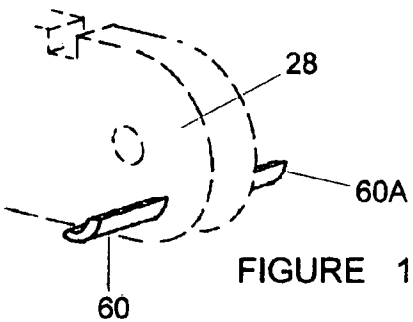
FIG. 1B is a detail view of the tang area of the blade.
Figure 1:
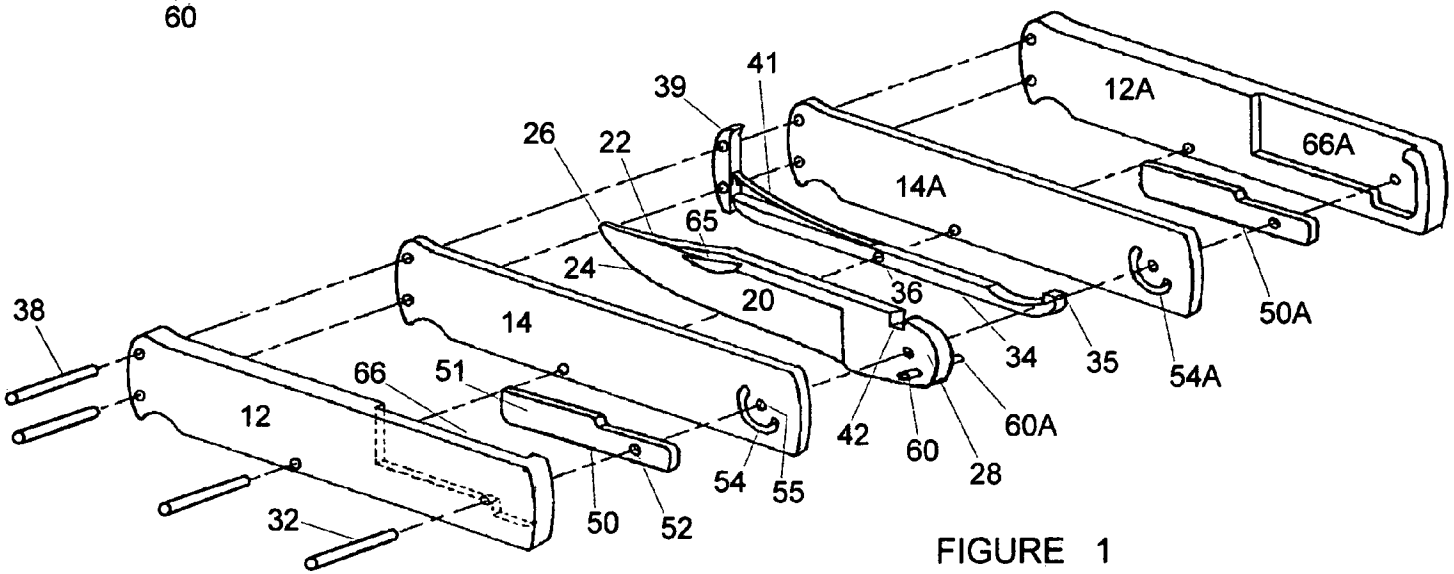
FIG. 1 is an exploded view of a folding knife provided with a guard according to the present invention.

Turning now to the drawings, FIGS. 1 to 1B show a representative knife construction of the type which may be provided with the various embodiments of a folding guard according to the present invention. As mentioned above, knives can have different shapes and dimensions and it will be understood that the following general description of a conventional construction of a folding knife is for background and understand it being appreciated that the present invention and its various embodiments apply to a wide variety of knife types, shapes and sizes. Also, throughout this application and in the various drawings showing various embodiments, the same or similar numerals will, for convenience, be used to identify the same or similar components such as the knife handle, knife blade and the like.

Folding knife 10 generally has opposite handle sections 12 and 12A. The outer surface of the handle section may be provided with a suitable decoration or functional overlay of plastic, bone or other material and may include bolsters. Liners 14 and 14A are positioned at the inner side of the handles 12 and 12A.

The main blade 20 is interposed between the liners. The main blade 20 has a back 22, edge 24, tip 26 and a rear tang 28. The blade is pivotal about a pivot pin 32 extending transversely through the handle and liners. A leaf-style, rocker bar 34 assists to maintain the blade in an open position having a detent 35 at its forward end. The bar 34 provides a positive spring action to "snap" the blade closed. The rocker bar pivots about rocker pivot 36. The assembly is secured by rivets or fasteners 38. The end of the bar carries a spacer 39 and a rocker spring 41 extends between the spacer 39 and the bar to apply pressure on the bar. In the open position, the rocker bar detent seats in recess 42 in the tang 28. The above is a general description of the construction of representative folding knives to assist in understanding the present invention. The same numerals are used throughout to designate the same or similar elements.

FIGS. 1 and 1B

The present invention provides a knife safety guard having a pivotal mounting section and finger stop which stop will extend to protect the hands and fingers of the user when the knife blade is in the open or extended position. As seen in FIG. 1, the safety guard assembly includes a pair of finger stops or guards 50, 50A. Each of the guards 50, 50A is shown as having a generally elongate lever-like body 51 having a bore at 52 at their inner ends. Guard 50 is interposed between handle 12 and liner 14. Similarly, guard 50A is interposed between liner 14A and the inner surface of handle 12A. The pivot pin 32 extends through the pivot bore 52 in the pivotal mounting section of the guards and the bushing 55 in the liner. Appropriate bushings 55 may be provided in the assembly for smooth operation.

An arcuate slot 54 is provided in liner 14 adjacent the bore. Similarly, arcuate slot 54A is provided in liner 14A adjacent the transverse bore 52. The slots are disposed below the associated bore and extend for an arc length of about 180°.

The tang section 28 of the blade 20 carries lifting pins 60, 60A extending from opposite sides of the tang of the blade. The lifting pins 60 and 60A are disposed forwardly from the pivot pin 32 in the closed position. The pins 60, 60A are aligned with the arcuate slots 54 and 54A and project through the slots to engage the spaced-apart guards 50, 50A. It will be appreciated that when the knife is in the closed position, as shown in FIG. 1A, the guards assume an out-of-the-way position between the adjacent handle section and liner in the associated recesses 66, 66A. When the user wishes to use the knife, the user will engage the nail mark 65 on the blade and pivot the blade forwardly to the extended position. The pivoting of the blade will cause the lifting pins 60, 60A, to rotate about 90° to abut the guards. As the lifting pins rotate further, the guards will be moved to a generally perpendicular position with respect to the knife disposed on either side of the blade 20. When the user folds the blade to the closed position, the blade will rotate about 90° and then engage the guards causing them to rotate to the recessed, out-of-the-way position within the handle section. The inner surface of handles 12 and 12A each define a recess 66 and 66A configured to receive the guards in an out-of-the way position in the closed or retracted position.

FIG. 2

Figure 2:
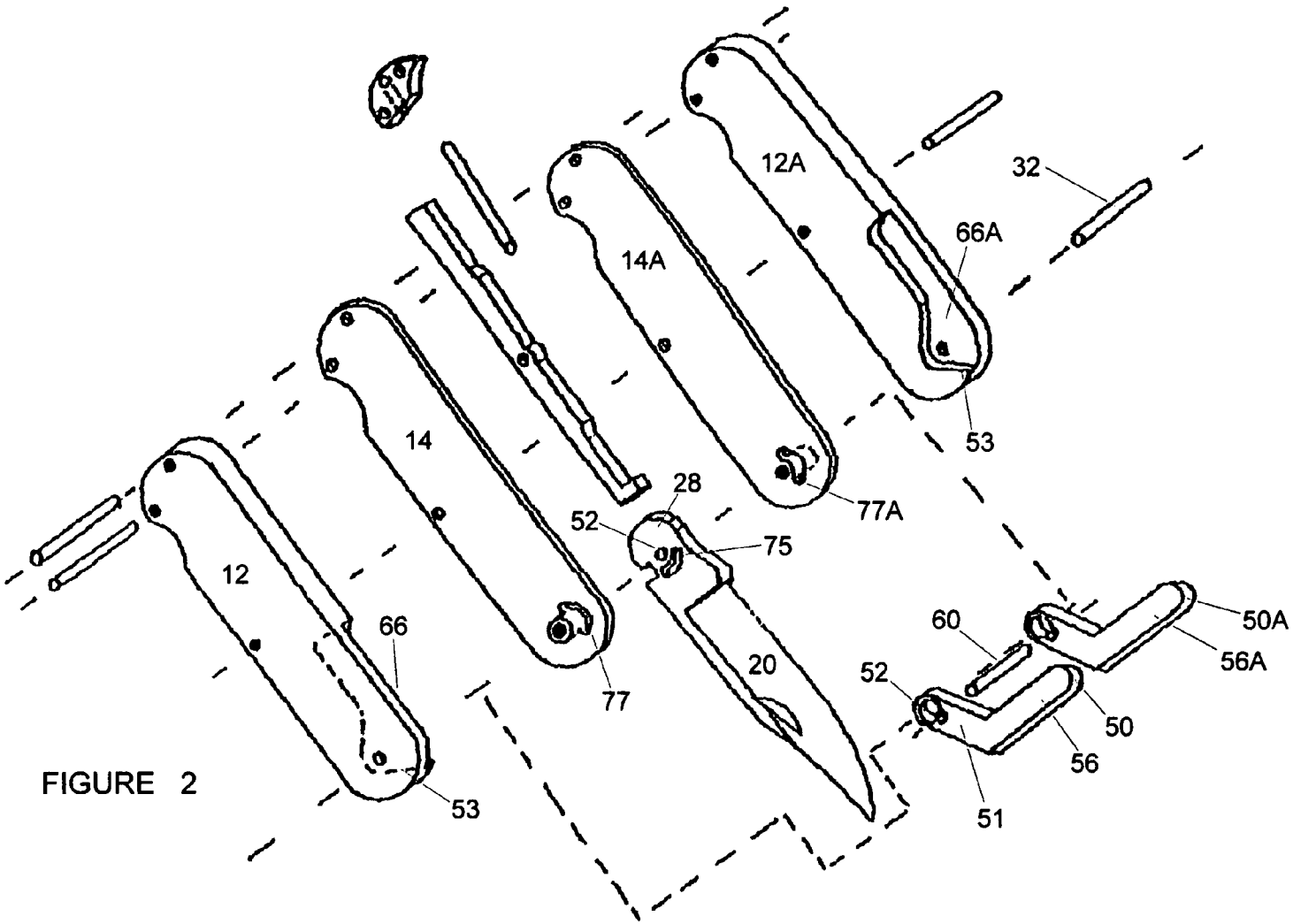
FIG. 2 is a exploded view showing yet another embodiment of the present invention in which the guards have an angular configuration.

Turning now to FIG. 2, another embodiment of the present invention is shown in conjunction with conventional folding knife 10 having handle sections 12 and 12A, liners 14 and 14A and blade 20 which is pivotally supported on a pivot pin 32 extending between the handles through the liners preferably in suitable bushings. The tang 28 of the blade 20 defines a generally arcuate slot 75, again having a common center with the center of the axis of the pivot pin 32. The arcuate slot 75 is displaced forwardly from the blade pivot 52 toward the point of the blade.

A pair of guards 50 and 50A are interposed between the handle and liners on either side of the blade 20. Each of the guards has a general V-shape with upper finger stops 56, 56A and lower pivotal mounting section 51 disposed at approximately a 45° angle with respect to the finger stop. The lower pivotal mounting sections 51 each define a bore 52 through which the blade pivot pin 32 extends. A lifting pin 60 extends between the guards 50, 50A and is secured to the lower sections 51 of the guards spaced from the pivot pin.

Arcuate slots 77, 77A are provided in the liners. It will be noted that the slots 77, 77A in the liners and the slot 75 in the blade 20 are positioned relative to one another so that as the blade 20 is manually rotated to the open position, the end of the slot 75 will not engage the lifting pin 60 until the blade is approximately perpendicular to the handles. Continued rotation of the blade will cause the end of the slot to move the guards upwardly out of their position in recesses 66, 66A in the handles. When the blade is fully extended, the finger stop section of the guards will extend generally vertically from the handle. The recesses 66, 66A are configured so the lower section 51 of the guards will rest on edge 53 of the recesses.

As the blade is closed, the blade will rotate approximately 90° at which time the opposite end of the slot in the blade will engage the lifting pin causing the guards to fold into the retracted position in their associated recesses 66, 66A when the blade is fully closed. An advantage of this embodiment is that the slot 75 in the blade is disposed forwardly in an area of the tang which generally has greater material width.

FIG. 3

Figure 3:
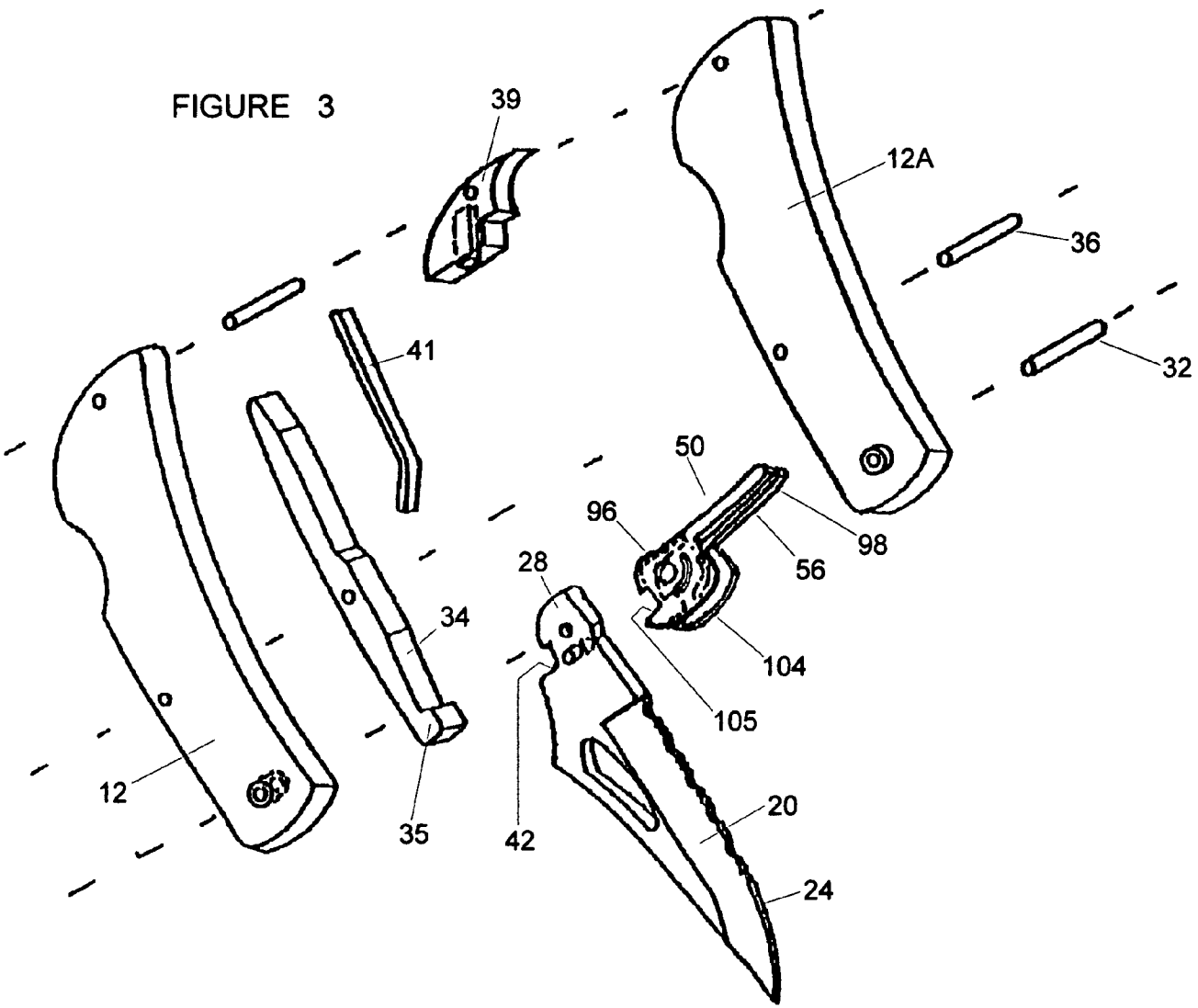
FIG. 3 shows an embodiment of a folding knife according to the present invention in which a single guard is held in an open position by the rocker bar.

In FIG. 3, yet another embodiment of the guard of the present invention is shown, again in conjunction with a knife having opposite handle sections 12 and 12A separated by a spacer 39 and a spring bar 41 intermediate the handle sections. A rocker bar 34 extends axially along the handle and has a projection or detent 35 at its forward end. The blade 20 is pivotally mounted between the forward sections of the handle and pivots on a pivot pin 32. Similarly, the rocker bar is pivotally mounted on a pivot pin 36 extending between the handle sections 12 and 12A.

The blade 20 has a notch 42 in the tang section 28. When the blade is in the open or extended position, the notch 42 will be engaged by the detent 35 or projection on the rocker bar to assist in maintaining it in the open position to prevent it from inadvertently closing when in use. The guard 50 has a mounting section with spaced-apart flanges 104 and upstanding finger stop 56. A transverse bore 96 extends between spaced-apart wall sections.

A blade-receiving groove 98 extends along the edge of the finger stop section of the guard. The spaced-apart sections of the guard each define a notch 105 which conforms to the shape of the notch in the tang of the blade. In the closed position with the blade in a protected position between the handle sections, the edge 24 of the blade will rest in the groove 98 in the face of the guard. When the blade is manually extended and the guard deployed to a generally perpendicular position with respect to the handle, the notch in the tang of the blade, as well as the notches in the lower body portion of the guard, will be engaged by the detent projection 35 on the forward end of the rocker bar. The end of the rocker bar 34 snaps into both the guard and the blade to assist in maintaining them in the open position. The lifting pin can be eliminated if the underside of the blade is used to lift the guard into the open position.

Figure 4:
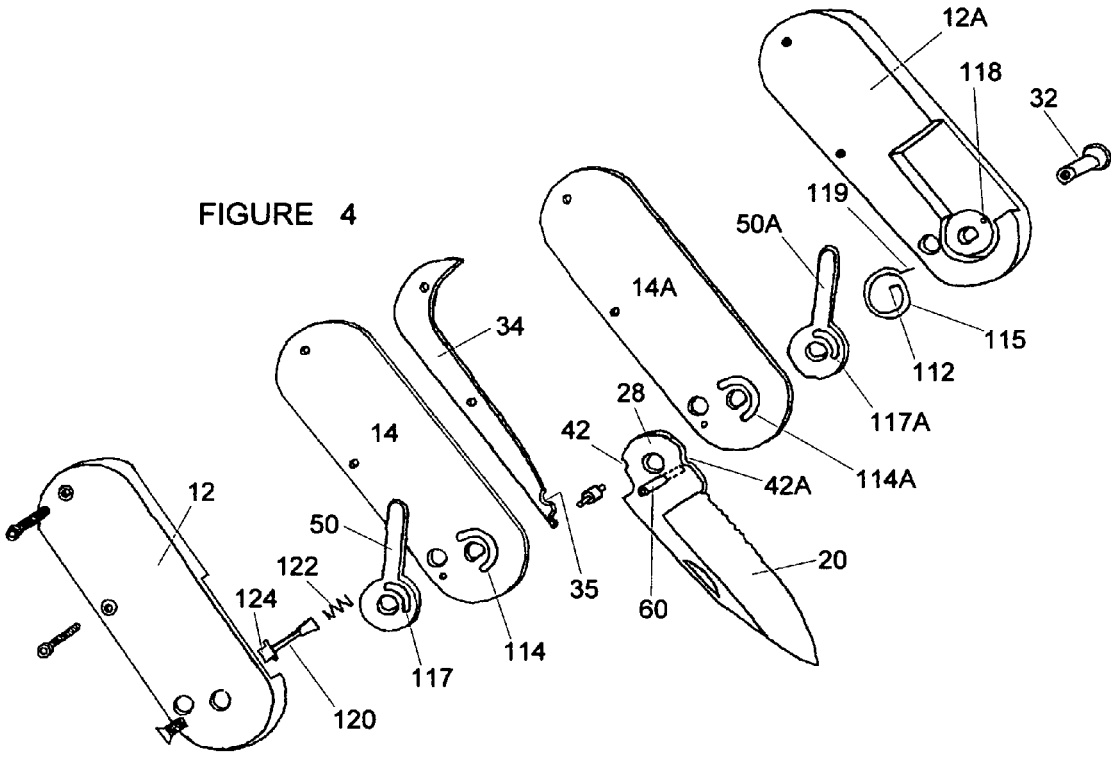
FIGS. 4 and 4A illustrate a guard which may be used in connection with automatic or spring-activated knives.
Figure 4A:
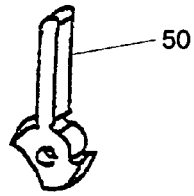

FIGS. 4 and 4A

FIGS. 4 and 4A show an embodiment for automatic knives having a pair of guards 50 and 50A disposed on opposite sides of the blade 20 which pivot on pin 32. Arcuate slots 114, 114A in the liners 14, 14A align with slots 117, 117A in the pivotal mounting section of the guards. A lifting pin 60 extends through the aligned slots in the liners and guards. The lifting pin engages one end 112 of a coil spring 115. The opposite end 119 of the spring seats in a bore 118 in the handle section. Alternatively, the spring end 112 can be extended through the 90° slot in the guards directly into the blade itself. The spring end 112 goes through the blade and makes contact with both guards. In this manner, the spring acts as a lifting pin as well.

The blade 20 is retained in a closed position by detent pin 120 which is spring biased by spring 122. When the detent button 124 is depressed, the retention force is released allowing the coil spring 115 to pivot the blade to the open position in which the detent pin 120 is seated in the notch 42 in the tang 28. In the closed position, notch 42A is engaged by the detent pin 120. The lifting pin 60 on the blade will rotate upwardly and forwardly engaging the forward ends of the slots in the guards rotating them to an upright position.

FIG. 4A shows an alternate configuration for the guard 50 having a base shaped or relieved to provide clearance for the button lock of the type used on automatic knives.

Figure 5A:
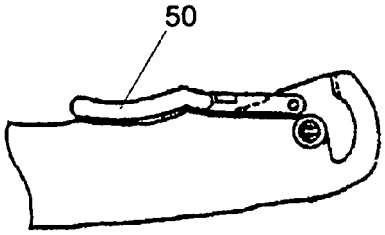
FIGS. 5 and 5A illustrate a pair of guards pivotal by a lifting pin that is attached to the blade which pin can be moved to various locations on the blade permitting a corresponding change in the configuration of the guard, handle and liner.
Figure 5:
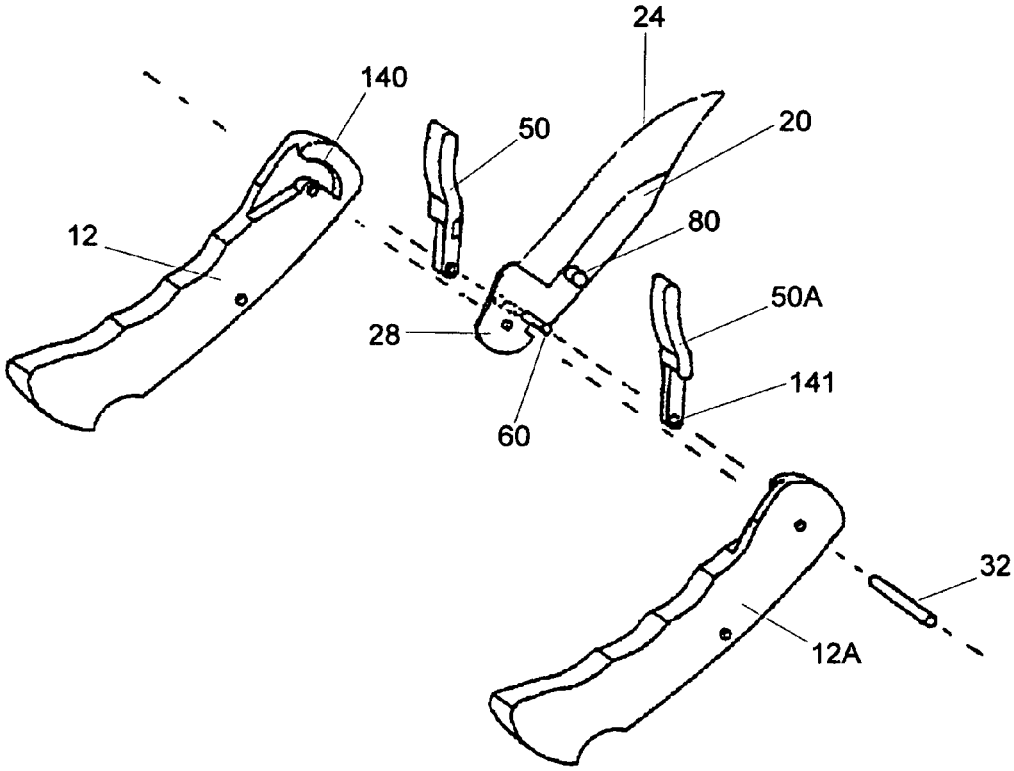

FIGS. 5 and 5A

Turning to FIGS. 5 and 5A, a knife with guards 50, 50A is shown having opposite handle sections 12, 12A, having their pivot locations centered on the lifting pins. It is to be noted that in these various embodiments, liners may or may not be included. The knife has a blade 20 with a blade edge 24 and a tang 28. A pivot pin 32 extends transversely through the tang portion of the blade and is received in bores in the forward end of the handle. A lifting pin 60 extends transversely from the blade forward of the pivot pin. The lifting pin 60 extends through bores 141 in the lower mounting end of the guards 50, 50A. In the closed position, a thumb stud 80 projecting from the blade holds the guards closed. When the blade is rotated to the open position, the lifting pin 60 will rotate with the blade to pull the guards to an open position by first applying a dragging motion and then a flipping motion to the guards as the lifting pin 60 passes by the contour defined by the blade's pivot pin 32. Note the lifting pin can be placed at different positions on the blade with a corresponding change in the configuration of the guards and the shape and location of the recesses 140 in the handles.

Figures 6, 6A, 6B:
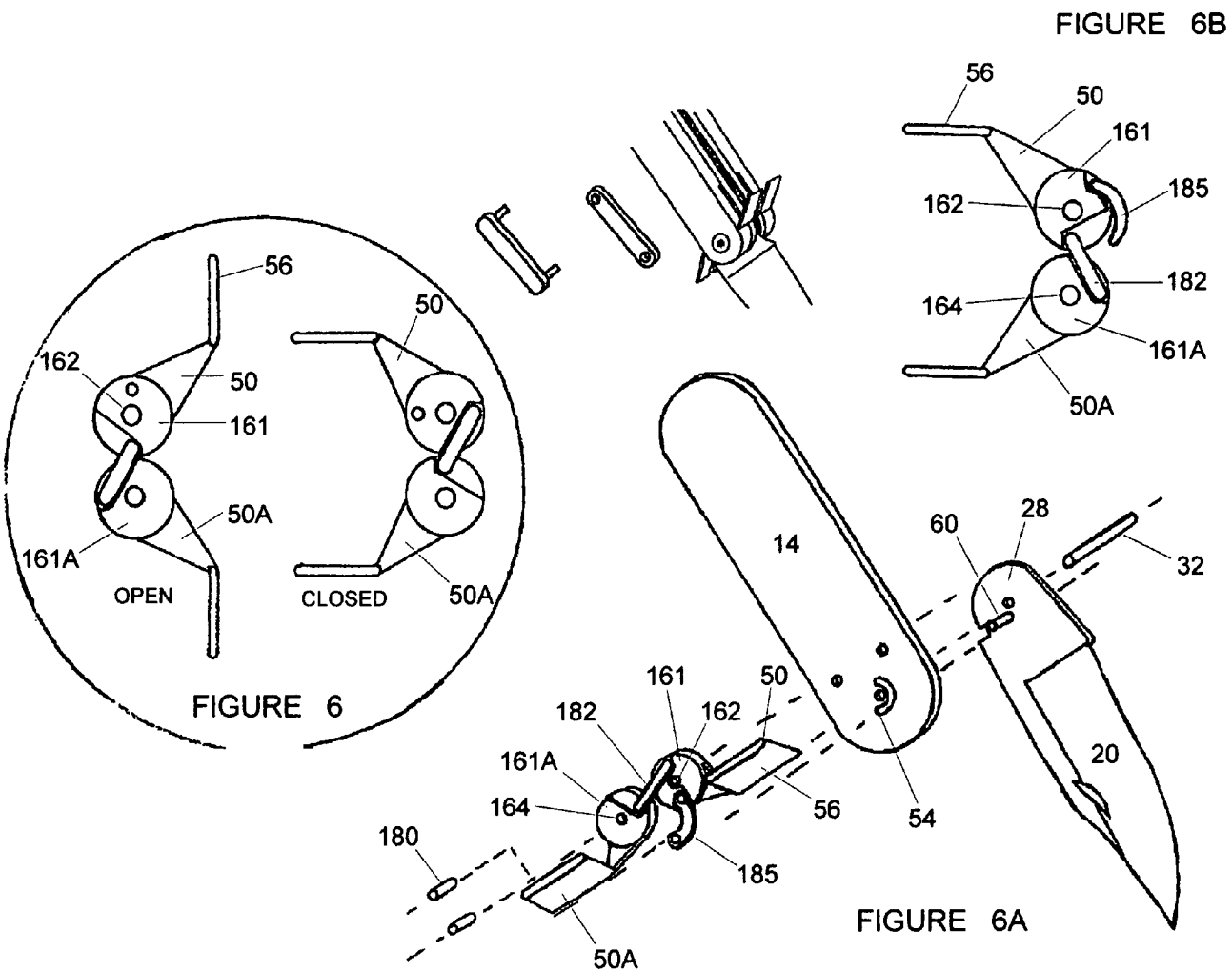
FIGS. 6 to 6B show double-sided guards which are joined by a linkage which when extended project both from the top and bottom of the knife handle.

FIGS. 6 to 6B

FIGS. 6, 6A and 6B illustrate dual top and bottom guards in which both guards 50, 50A are raised by a lifting pin 60 located on the blade 20. FIG. 6 illustrates both the closed and deployed position. Referring to FIG. 6A, the blade 20 has a tang 28 with a pivot bore which receives a pivot pin 32. The pivot pin extends through the adjacent liners into opposite handles. A pair of opposed guards 50, 50A are shown disposed adjacent the liner 14. Similarly, another pair of guards may be provided on the opposite side of the blade and will operate in the same manner as those shown.

The upper guard 50 has a circular base 161 with a center circular bore 162 which is coincident with blade pivot 32, as seen in FIG. 6 which represents one optional construction. The upper guard has an upwardly projecting finger stop or paddle 56. Similarly, the lower guard has a circular base 161A which has a central circular bore 164 which is pivotal about a pivot pin 180 disposed below the upper pivot pin. The blade carries a lifting pin 60 which extends transversely through the slot 54 in liner 14. The upper end of link 182 is pivotally connected to circular base 161 and the lower end to base 161A. Arcuate link 185 connects the base of the upper guard to the lifting pin in one option as seen in FIG. 6A. Another pair of upper and lower guards 50, 50A, as described above, may be provided on the opposite side of the blade so two guards project both upwardly and downwardly from the handle. Both the open and closed positions of one pair of guards are shown in FIG. 6 and it will be understood that the lifting pin operating through links 185 and 182 will simultaneously deploy and close the guards shown in FIG. 6B.

Figure 7:
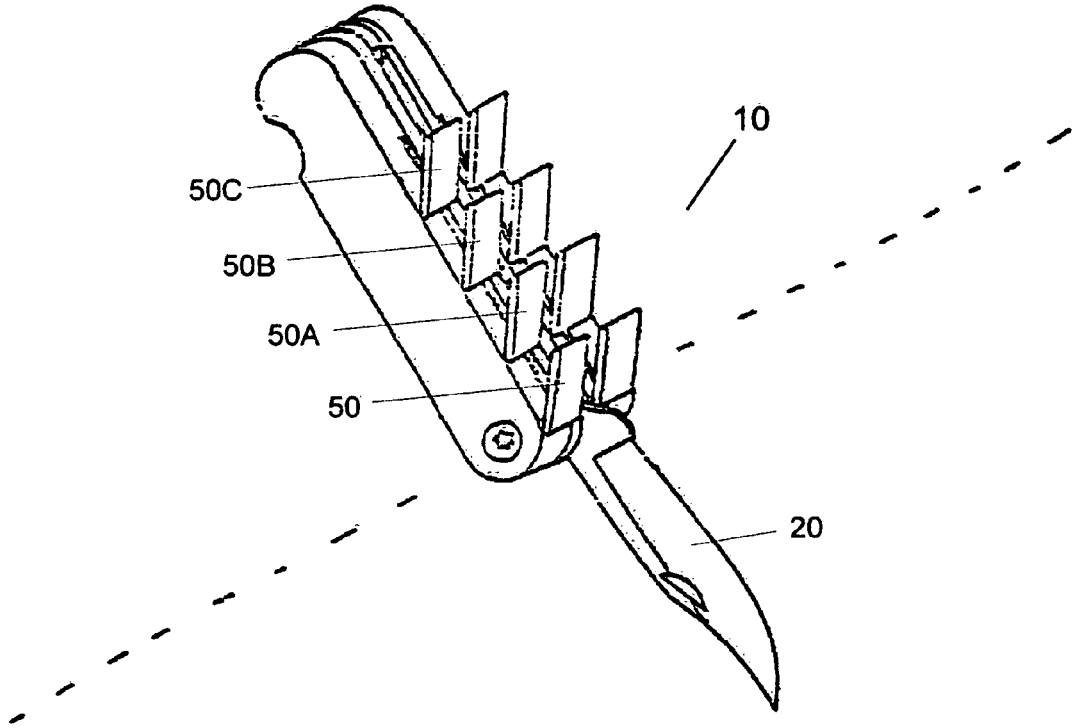
FIGS. 7 through 7B show an embodiment in which the knife is provided with multiple in-line guards which are simultaneously raised and lowered.
Figure 7A:
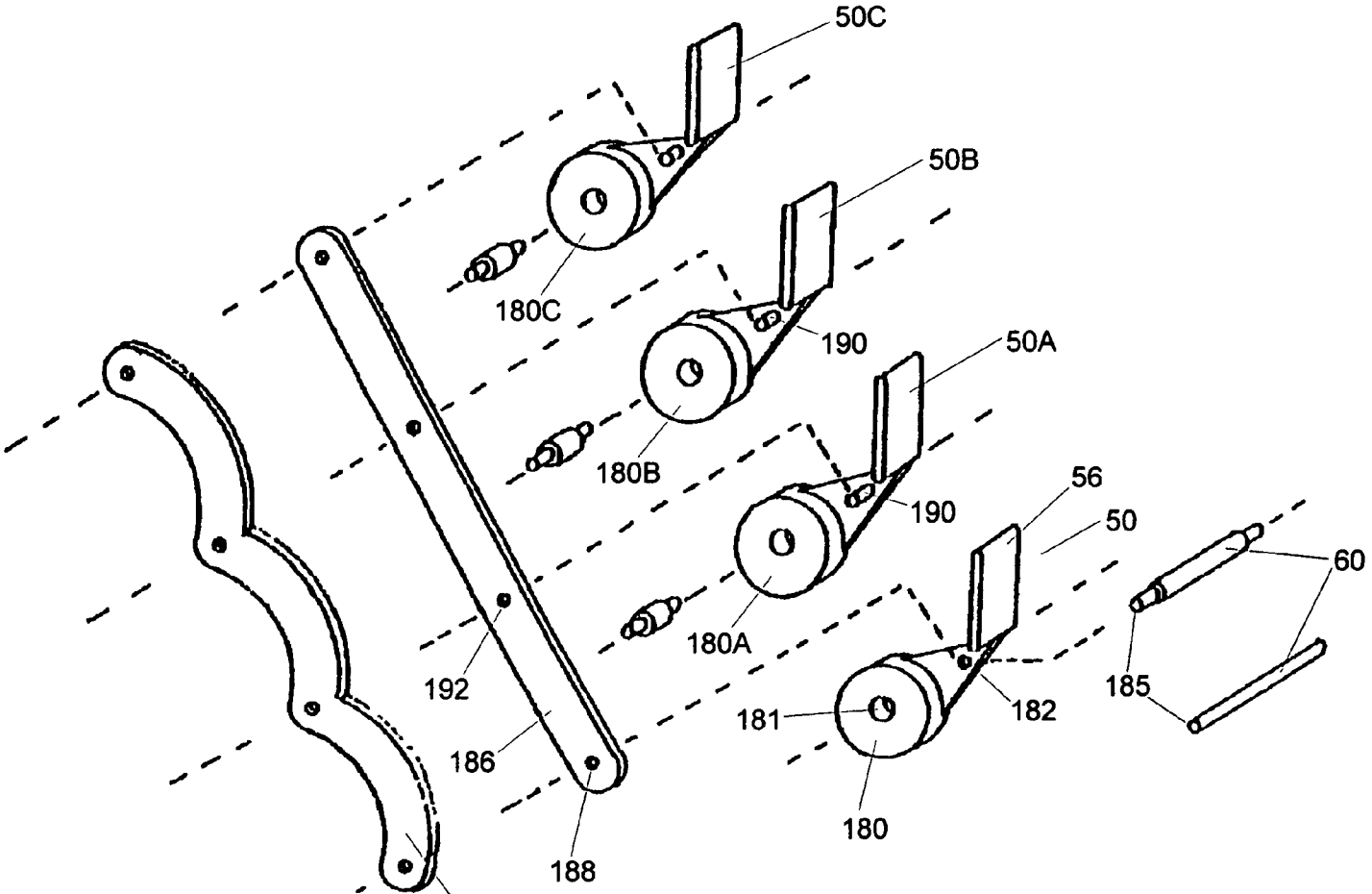
Figure 7B:
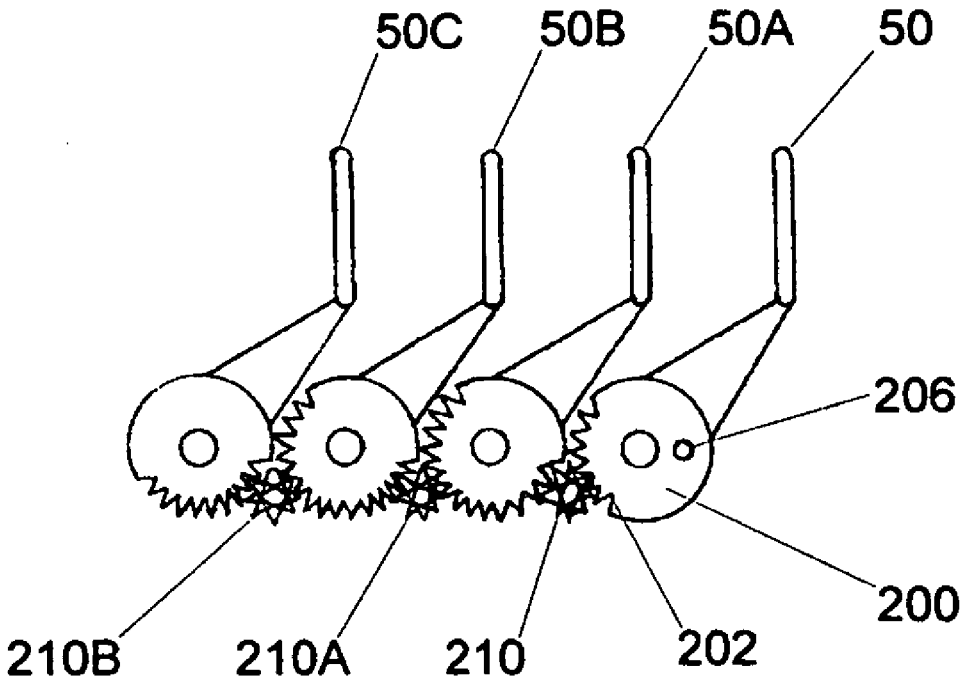

FIGS. 7 to 7B

FIGS. 7, 7A and 7B show a knife 10 provided with a plurality of spaced-apart, inline guards 50, 50A, 50B and 50C. The spaces between the guards define areas for receiving the user's finger.

In FIGS. 7, 7A, the forward guard 50 has a circular base and an upstanding finger stop or paddle 56. The mounting section 180 has a central pivot bore 181 through which a pivot pin or screw post for the blade extends. Radially offset from the pivot bore is a bore 182 which receives a lifting pin 60 which extends through the blade.

The lifting pin 60 defines bearing surface 185 at its opposite ends. An axially extending link 186 has a bore 188 at its forward end which receives the bearing surface 185 at the end of the lifting pin. The additional guards are pivotally arranged in spaced-apart relationship along the link 186, three being shown. Each of the guards, again, has a circular mounting sections 180A, 180B and 180C with a central pivot bore and an upstanding finger stops. A pivot post 190 projects from the flange area of these guards and is received in adjacent bore 192 in the axially extending link 186. The link 186 may be axial or have arcuate sections as identified by the numeral 186A.

It will be seen that, as the blade 20 is rotated from the closed to the open position, the lifting pin 60 and link 186 will rotate the guards 50, 50A, 50B and 50C to their open position in which the guard portions extend upwardly and are spaced apart along the top surface of the knife. The spacing is selected to accommodate the fingers of the user. This is seen in FIG. 7.

FIG. 7B shows an alternate arrangement of actuating a plurality of spaced-apart guards 50 to 50C. In this embodiment, the forward guard 50 has a circular mounting section 200 and a finger stop. A portion of the periphery of the circular section defines gear teeth 202. The forward guard has a bore 206 offset from the pivot bore which receives a lifting pin which rotates the guard 50 between an open and closed position in the manner as has been described previously. The additional guards 50A to 50C are similarly constructed, each having a circular mounting section. Each is pivotal about a pivot axis extending between the handle sections and the liners. Approximately 180° of the surface of the circular section of the guards 50A, 50B and 50C define gear teeth 202. The teeth do not directly contact one another. Small gears 210, 210A, 210B are interposed between the first and second guards (50, 50A), the second and third guards (50A, 50B) and the third and fourth guards (50B, 50C). The gears 210 to 210B are transfer gears and transfer the motion of the forward lift pin actuated guard 50 to the remaining guards so that they simultaneously move between the open and closed positions when the blade 20 is rotated between the open and closed positions.

Figure 8:
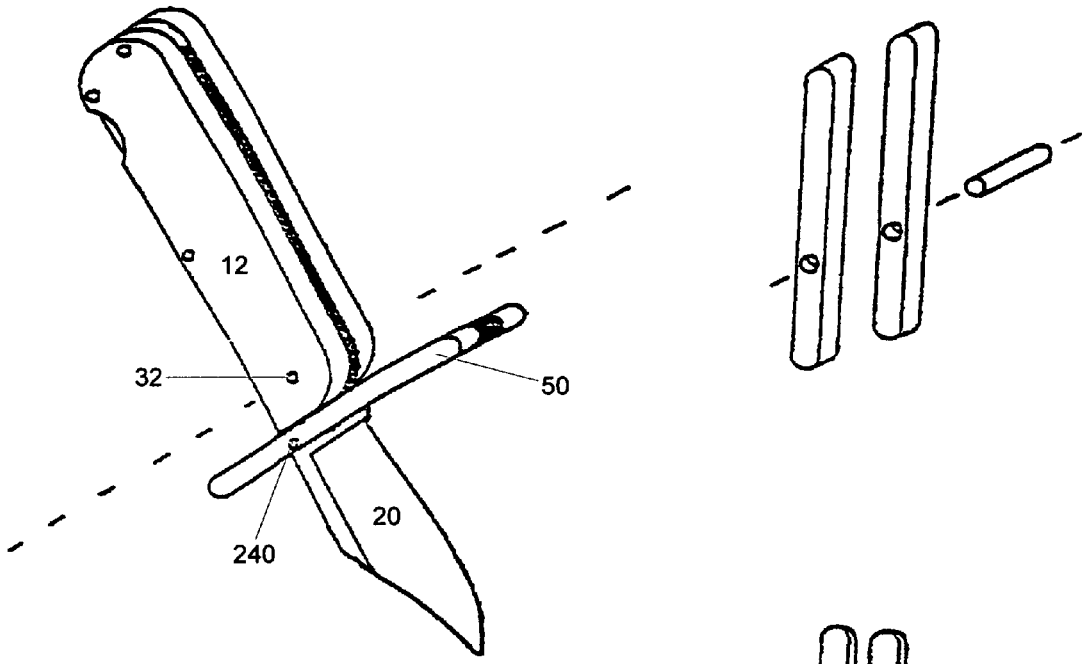
FIGS. 8 and 8A show another version having a guard which is "dragged" and "flipped" to the deployed position when the blade is opened.
Figure 8A:
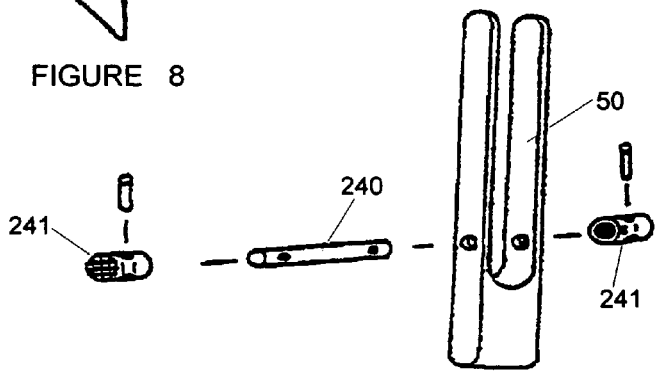

FIGS. 8 and 8A

In FIG. 8, the guards 50 are pivotally attached to blade 20 forward of the blade pivot 32 at a pivot 240 disposed toward the back 22 of blade 20. The guard 50 may take various shapes and is shown as an elongate bar. As the blade is manually opened, the guard 50 will engage the front edge of the knife and be "dragged" and "flipped" to the deployed position.

In FIG. 8A, the guard 50 is a slotted, one-piece section pivotal about pivot pin 240 and is dragged and flipped to the deployed position. The ends of the pivot pin 240 are provided with thumb stud caps 241 to assist in opening the blade 20 and guard 50.

Figures 9, 9A, 9B, 9K, 9L:
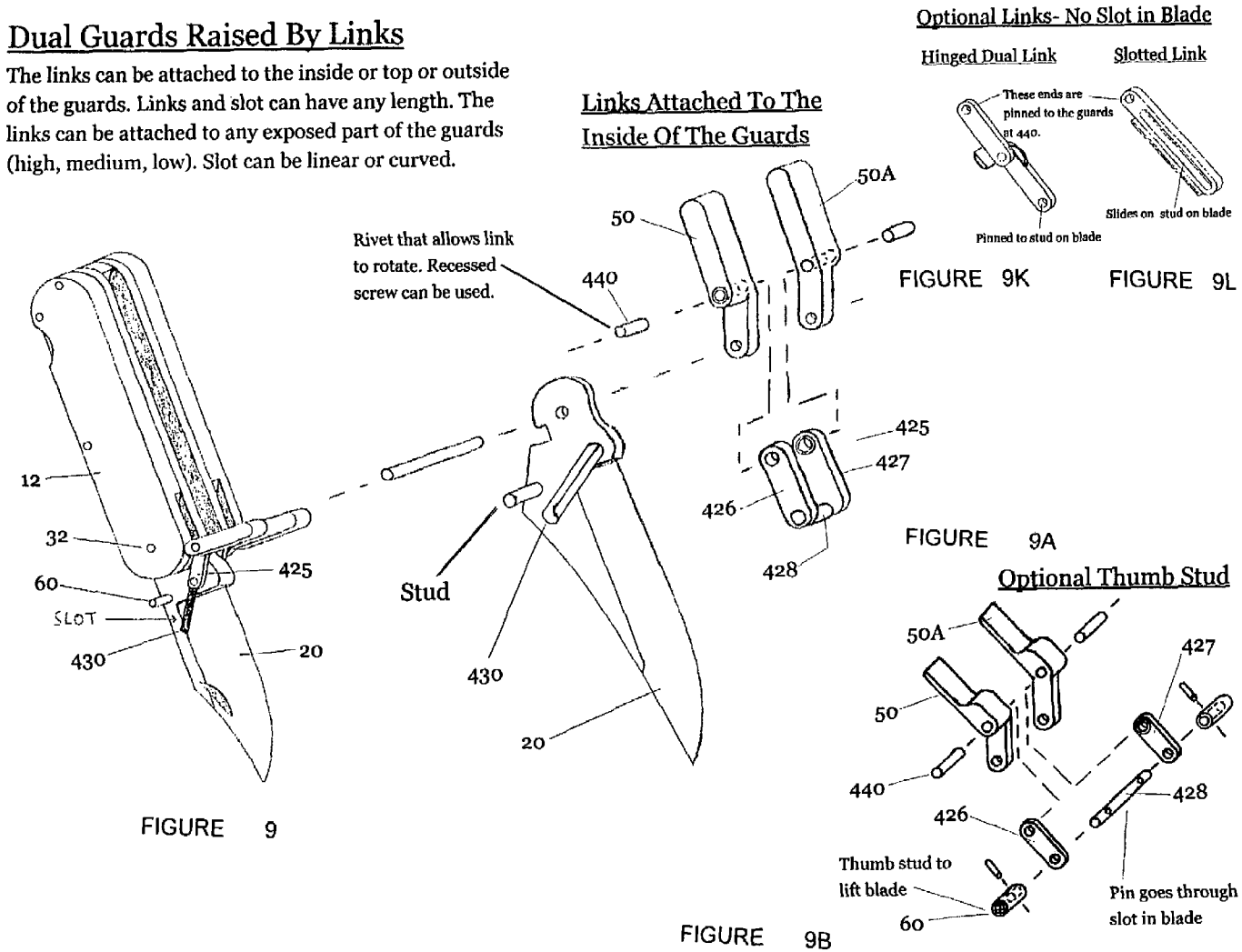
FIGS. 9 to 9L show an embodiment in which one or more guards are actuated by a linkage.

FIGS. 9 to 9L

In these embodiments, links are attached to the guards to raise the guards. The knife is as previously described having a blade 20 pivotal on pivot pin 32 which extends between the handle sections. Liners may also be incorporated as has been described.

In FIGS. 9 and 9A, a link assembly 425 has a pair of links 426, 427 joined by a pin 428. The pin 428 extends through a slot 430 in the blade. The links 426, 427 are each pivotally attached to a guard 50, 50A respectively. The guards sit on top of the handles 12 in the closed position. The links may be attached to various locations on the guards. FIG. 9 shows the links attached to the inside of the guards, however any exposed location such as on the outside or nearer the top end of the guards will work. The links are pivotal on pin or rivet 440.

The blade 20 may be manually rotated to an open position at stud 60. The opening and closing movement of the blade 20 will raise and lower the guards 50, 50A as the linkage assembly slides in slot 430. The shape and length of the slot can vary depending on the physical shape and dimension of the knife, blade and guards. FIG. 9B shows an optional construction in which thumb stud 60 is provided on the opposite ends of pin 428.

Figure 9C:
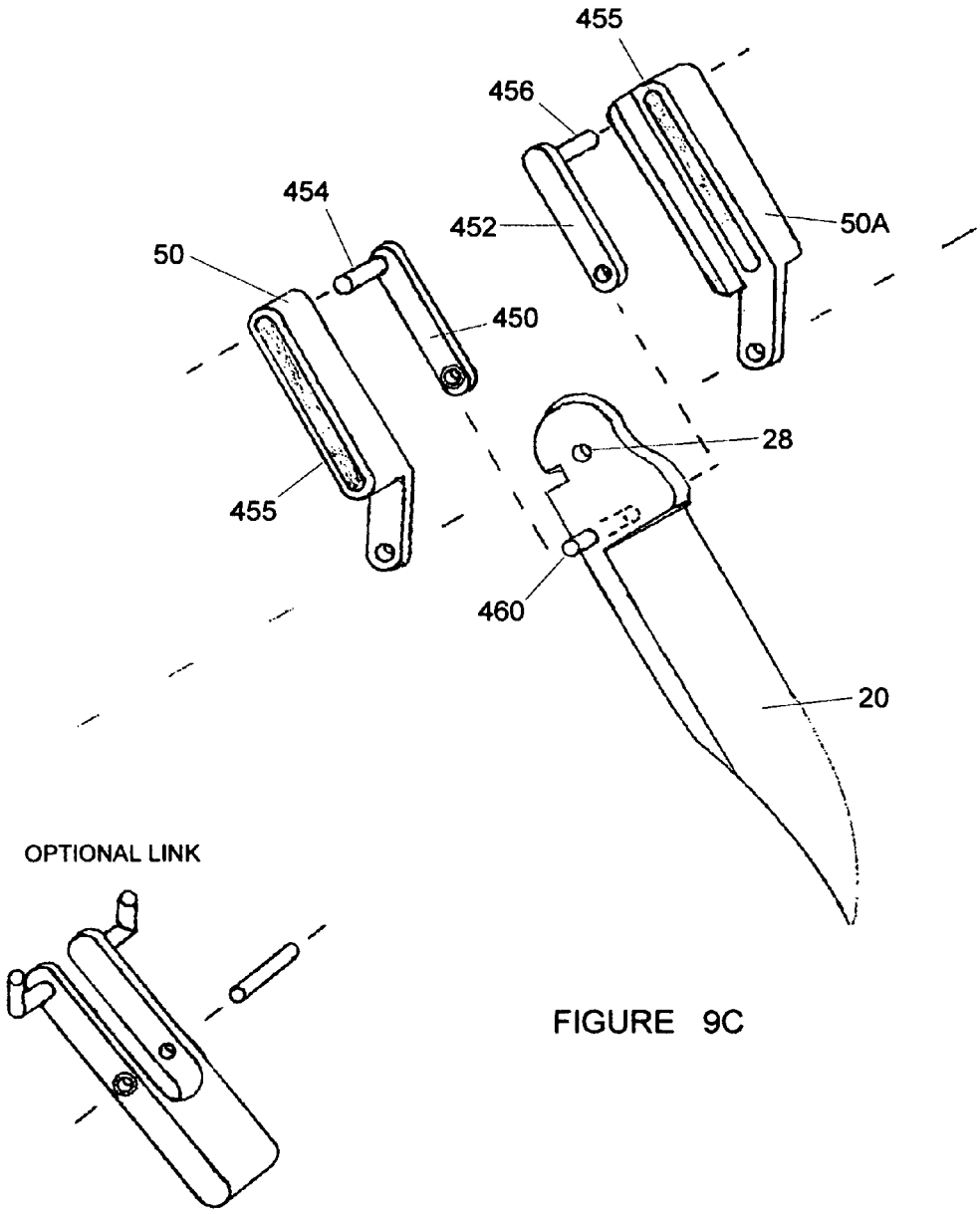

FIG. 9C shows a similar arrangement in which slots 455 are provided in the guards 50, 50A and the link pins 454, 456 on links 450, 452 engage the slots 455. Rotation of the blade 20 will pivot the guards via the links. The guards pivot on the blade pivot axis 28 and the links pivot on stub shaft 460. The ends of the shaft 460 are compressed after the links are attached to retain the links 460.

Figure 9D:
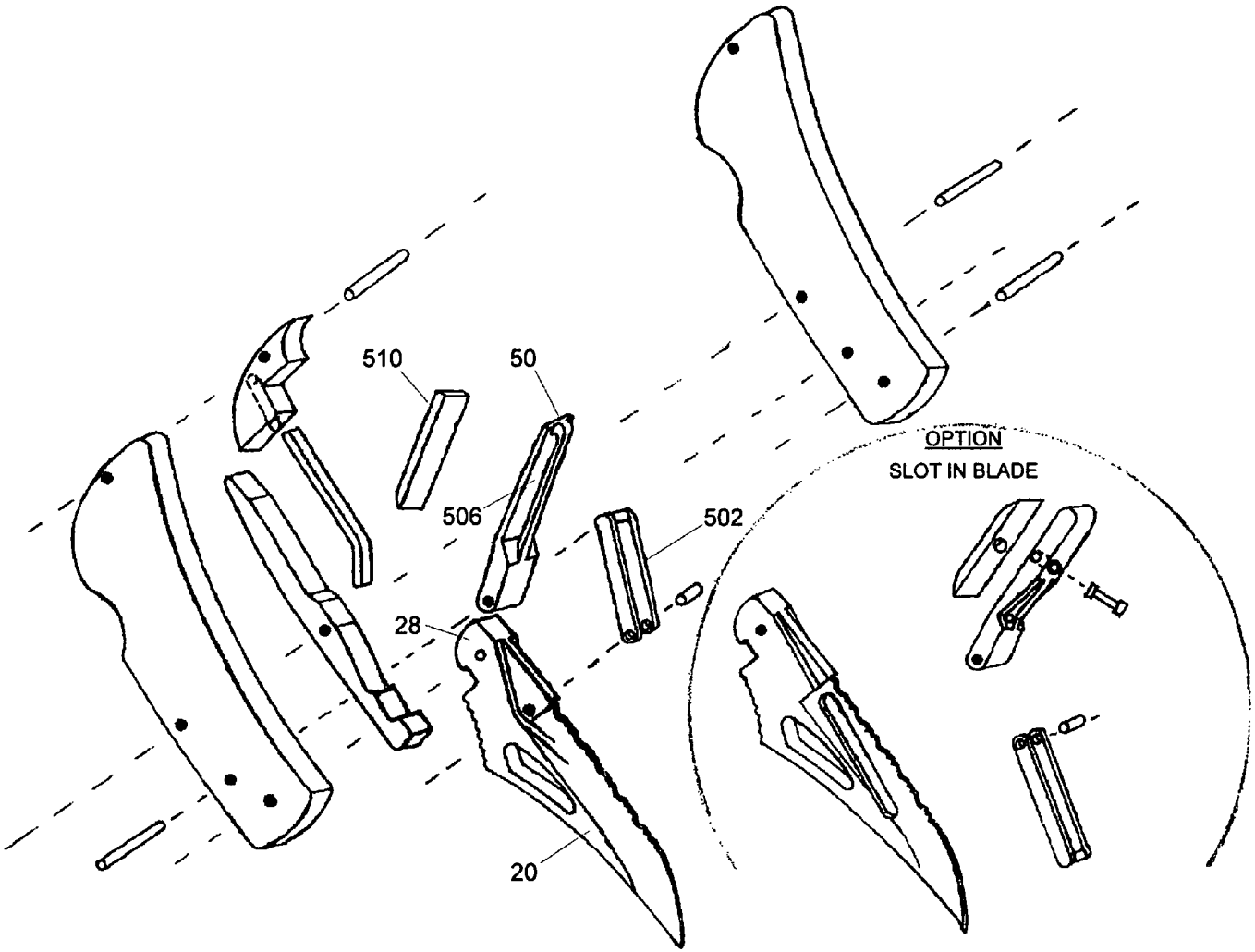

In FIG. 9D, the lower end of linkage assembly 502 is attached to the blade 20 and at the other end is slidable along a slot 506 in guard 50. The linkage will raise or deploy the guard. The forward movement of the guard is stopped by engagement with the rear of the tang section 28 of the blade. For comfort and convenience, the guard 50 may be provided with an elastomeric pad 510 which may be adhesively secured to the rear of the guard.

Figures 9E, 9F, 9G, 9H, 9I, 9J:
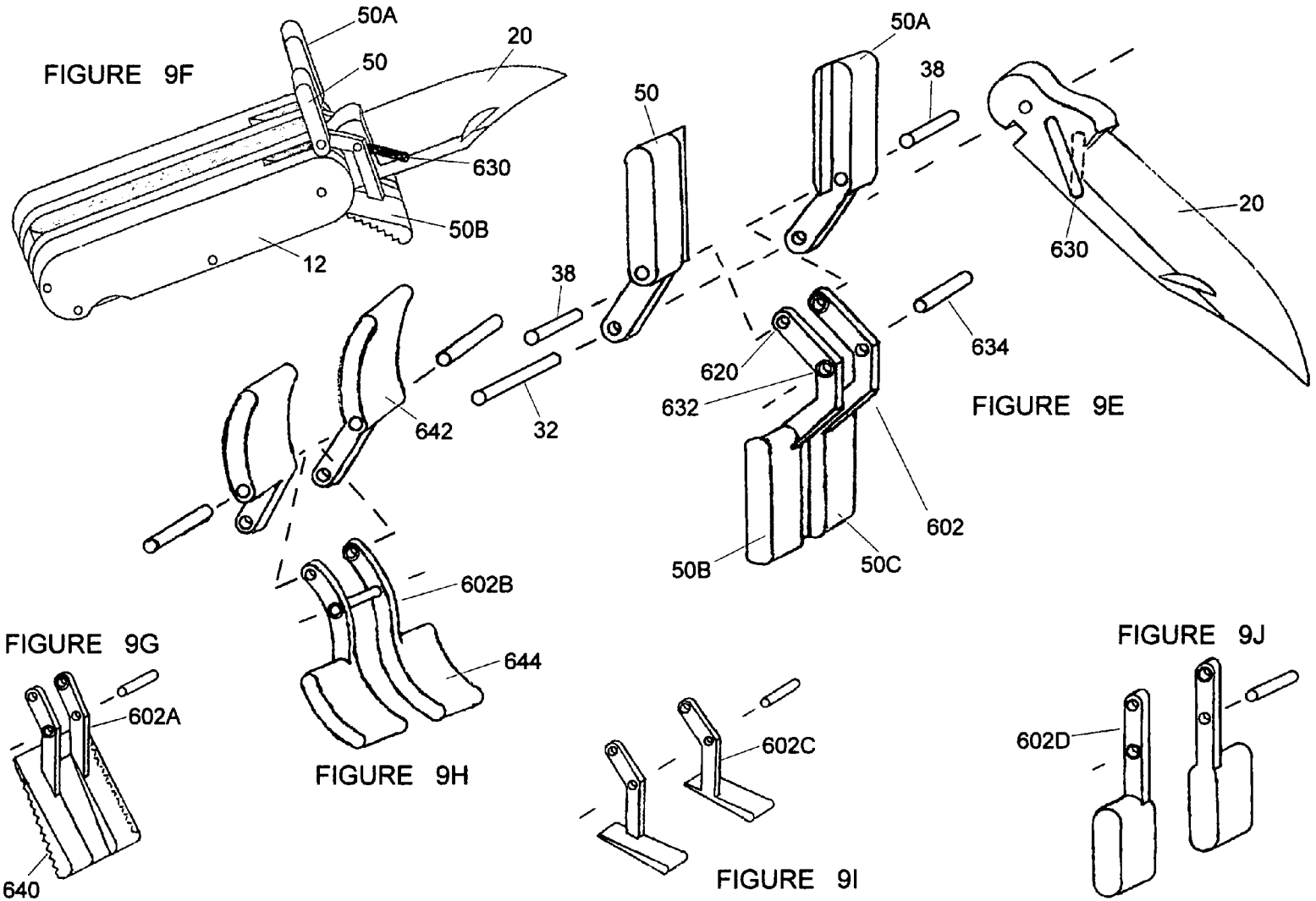

FIG. 9E shows another variation of the knife of the present invention in which quadruple guards are actuated by links engaging a slot in the blade. The knife blade 20 is pivotal in handles 12 on pivot pin 32. Top guards 50, 50A are angular and also pivot on pin 32. The lower guards are connected to the top guards at pin 38.

The lower guards 50B, 50C have angled links 602. The ends of the links are bored at 620 and pivot on pin 38. The blade 20 defines a slot 630 and pin 634 extends through the slot 630 at intermediate bores 632 in the links. Rotation of the blade 20 to the open position shown in FIG. 9F will simultaneously deploy the upper guards 50, 50A and the lower guards 50B, 50C in a position generally perpendicular to handle 12.

In FIG. 9G, the links 602A on the lower guards are angled to the guards, when deployed, are at approximately 45° with respect to the handle. Ridges 640 are provided to reduce slip when the user's thumb is in contact with the lower guards.

In FIG. 9H, the upper and lower guards 50 to 50C each have paddles 642, 644 with curved surfaces.

FIGS. 9I and 9J illustrate other configurations for the links 602C, 602D to provide guards which, when deployed, are variously oriented and positioned to conform to the preference of the user.

FIGS. 9K and 9L

FIG. 9K shows a dual hinged link that eliminates the need for a slot in the blade. The upper links are pinned to the guard at 440. The lower links are pinned to the fixed stud on the blade. The links fold up next to one another. The thumb stub on the link pinned to the blade is eliminated as it would interfere with the folding operation.

FIG. 9L shows a slotted link that also eliminates the need for a slot in the blade. The upper end of the link is pinned to the guards at 440. The lower end of the link slides on a stud 60 on the blade.

FIG. 10

Figure 10:
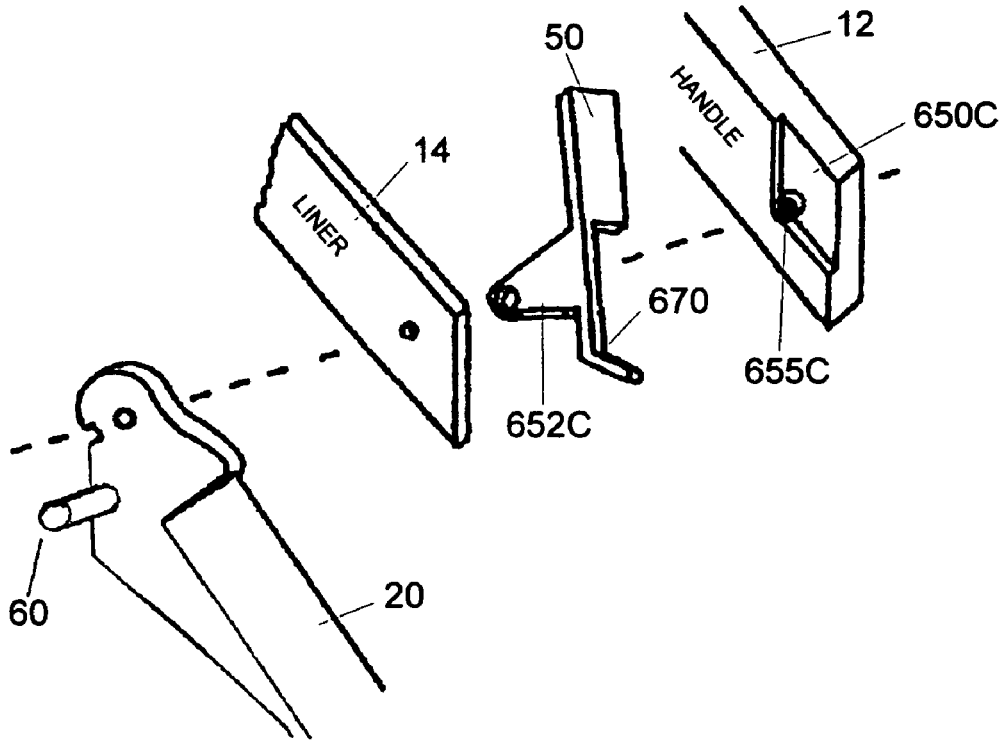
FIG. 10 shows an embodiment having a guard and a thumb stud which may open or close the guard.

In FIG. 10, the guard 50 has a projection 652C which is received within recess 650C on the inner side of handle 12. The guard 50 is pivotal on pivot 655C. A cut-out 670 contacts the thumb stud 60 to lift the guard when the blade is opened. The thumb stud 60 engages the guard 50 at opposite ends to either raise or lower the guard.

FIG. 11

Figure 11:
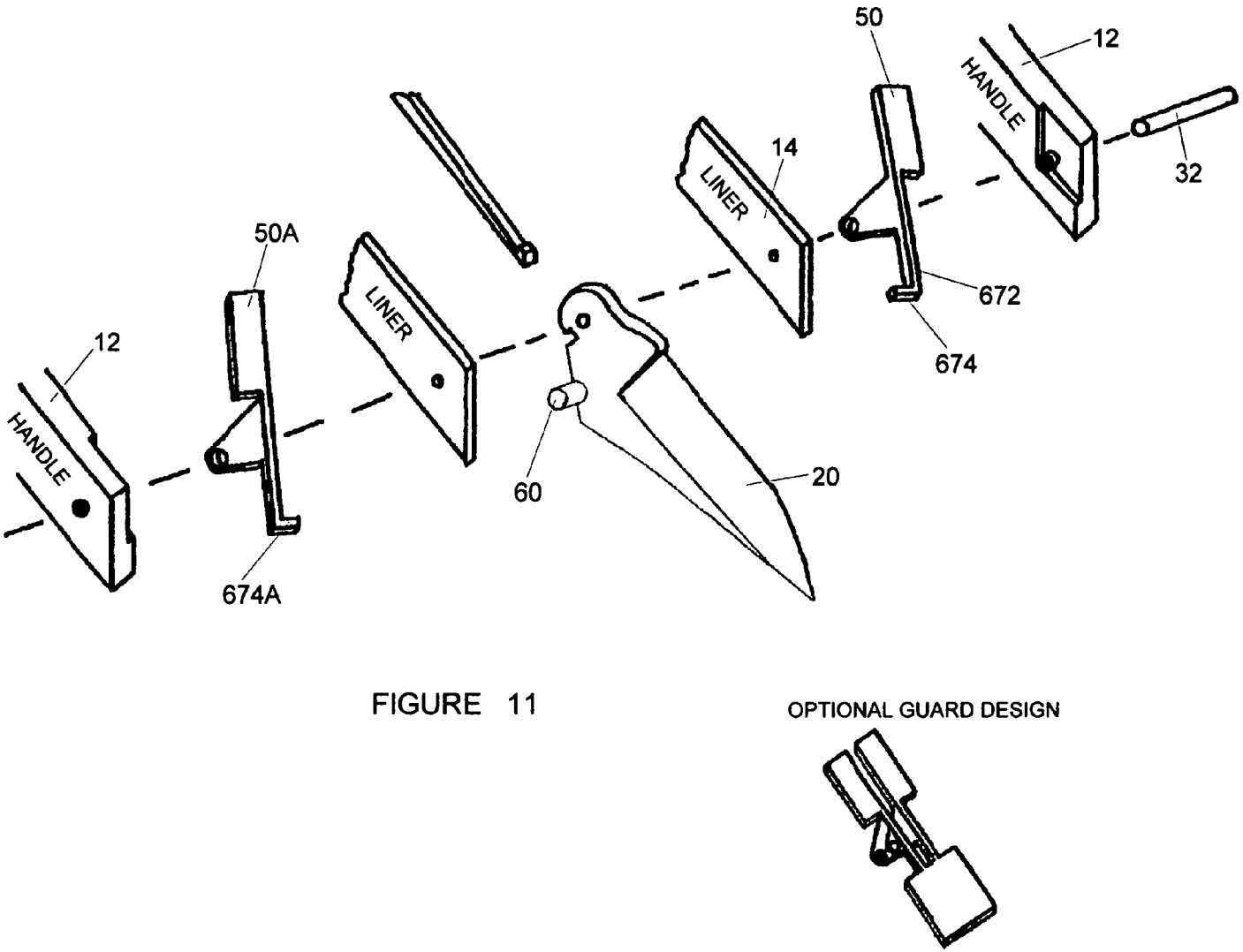
FIG. 11 shows an embodiment of a guard that hooks the back of the deploying blade to open the guard.

In FIG. 11, the guards 50, 50A each have a projection 674 extending from their lower ends 672. The blade 20 and the guards are pivotal about pivot pin 32. The thumb stud 60 closes the guards. The guards are deployed to an open position by the spine or back of blade 20 engaging the projections 674, 674A.

While the invention has been described with reference to folding knife applications, it will be appreciated that the invention may be applied to other tools which have a folding element such as folding saws.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A folding knife having a blade with a spine and knife edge, said blade being pivotally mounted to a handle at a pivot in the tang area of the blade and being pivotal approximately 180° between a closed position with the blade being retained in the handle and a fully opened position with the blade extending forwardly from the handle, said knife comprising:

(a) a folding guard having a front and rear surface, said guard being pivotally mounted to one of said handle or blade;

(b) said handle having a stop on the forward end and said handle receiving said guard in a stored position aligned with the blade; and (c) a lift on said blade tang area, said lift radially displaced from the blade pivot to engage the guard after the blade has been rotated approximately 90° from the stored position and upon further rotation of the blade the lift and guard remain in engagement causing the blade to move to a fully opened position and the guard to pivot to a fully opened position, the guard being generally perpendicular to the handle with the guard engaged against the stop on the handle retaining the guard in a locked position.

2. The folding knife of claim 1 further comprising a second guard disposed on the opposite side of the blade.

3. The folding knife of claim 1 wherein said guard lift is on said blade.

4. The folding knife of claim 1 wherein said guard lift means comprise a spring.

5. The folding knife of claim 4 wherein said guard lift means comprises a lifting pin attached to said blade and wherein said spring is attached to said lifting pin.

6. The folding knife of claim 1 wherein said guard lift means comprises a link actuated by said blade.

7. The folding knife of claim 1 including multiple inline guards simultaneously actuable by said lift means and wherein said lift means comprises link means or gear means.

8. The folding knife of claim 1 wherein said guard is pivotally attached to said blade and said guard is dragged forward and flipped to a deployed position as said blade is opened.

9. The folding knife of claim 1 wherein the guard has resilient cushion means on the rear surface thereof.

10. The folding knife of claim 1 wherein a linkage extends between said blade and first guard to raise said first guard to a deployed position.

11. The folding knife of claim 10 wherein said linkage is slidable along a slot in said guard.

12. The folding knife of claim 10 wherein said linkage defines a slot which is slidable on a projecting stud on the blade or guard.

13. The folding knife of claim 1 wherein said lifting pin is also a thumb stud for manually lifting the knife blade.

14. The folding knife of claim 1 wherein said guard is pivotally attached to the blade and extends past the blade edge and back in the deployed position.

15. The folding knife of claim 1 wherein said blade defines a slot and wherein said guard lift means comprises a linkage slidable in said slot and pivotally connected to said first guard.

16. The folding knife of claim 15 wherein said linkage carries a second guard, said first and second guard oppositely projecting from said handle in a deployed position.

17. The folding knife of claim 1 wherein the spine of the blade is engageable with the guard to deploy the guard to the open position.

18. The folding knife of claim 1 having a hinged dual link.

19. The folding knife of claim 1 wherein said guard defines a slot which receives the lift.

20. The folding knife of claim 1 including a liner disposed between said blade and said guard, said liner defining a slot through which the lift extends.

21. The folding knife of claim 1 wherein said guard is received in a recess in said handle in said stored position.

22. The folding knife of claim 1 wherein said guard is positioned against the top of the handle in a stored position.

23. The folding knife of claim 1 wherein said guard and said blade have different pivot locations.

24. The folding knife of claim 1 wherein the guard has a resilient cushion on the rear surface thereof.

25. The folding knife of claim 1 wherein the guard is pivotally attached to the blade and extends around the blade in the deployed position.

26. A folding knife having a blade with a spine and knife edge, said blade being pivotally mounted to a handle at a pivot in the tang area of the blade and being pivotal approximately 180° between a closed position with the blade being retained in the handle and a fully opened position with the blade extending forwardly from the handle, said knife comprising:

(a) a folding guard having a front and rear surface, said guard being pivotally mounted to one of said handle or blade and having a lift pin extending therefrom;

(b) said handle having a stop on the forward end and said handle receiving said guard in a stored position aligned with the blade; and (c) said blade defining an arcuate slot with opposite first and second ends in the tang area receiving said lift pin, said slot concentric with the blade pivot, said first slot end engaged by said pin after the blade has been rotated approximately 90° from the stored position and upon further rotation of the blade the lift pin and first slot end remain in engagement causing the blade to move to a fully opened position and the guard to pivot to a fully opened position with the guard being generally perpendicular to the handle and with the guard engaged against the stop on the handle retaining the guard in a locked position, said slot second end being engaged upon rotation of the blade approximately 90° toward the closed position from the opened position and whereby further rotation toward the blade closed position will return the guard to the stored position.

27. The folding knife of claim 26 further comprising a second guard disposed on the opposite side of the blade.

28. The folding knife of claim 26 including a liner disposed between said blade and said guard, said liner defining a slot through which the lift pin extends.

29. The folding knife of claim 26 wherein said guard is received in a recess in said handle in said stored position.

30. The folding knife of claim 26 wherein the guard has a resilient cushion on the rear surface thereof.

* * * * *